US006778634B2

(12) United States Patent
Thandiackal et al.

(10) Patent No.: US 6,778,634 B2
(45) Date of Patent: Aug. 17, 2004

(54) X-RAY GENERATING APPARATUS

(75) Inventors: Lijo Joseph Thandiackal, Bangalore (IN); Denis Perrillat, Paris (FR)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 91 days.

(21) Appl. No.: 10/283,432

(22) Filed: Oct. 29, 2002

(65) Prior Publication Data

US 2003/0081729 A1 May 1, 2003

(30) Foreign Application Priority Data

Oct. 31, 2001 (JP) ..... 2001-334149

(51) Int. Cl.[7] ..... H05G 1/02
(52) U.S. Cl. ..... 378/119; 378/193; 378/196
(58) Field of Search ..... 378/119, 193, 378/196

(56) References Cited

U.S. PATENT DOCUMENTS 1,975,871 A * 10/1934 Morse et al. ..... 378/199
2,132,174 A * 10/1938 Machlett ..... 378/142
5,497,409 A 3/1996 Jedlitschka et al.
5,920,605 A 7/1999 Lu
6,062,731 A 5/2000 Guzik
6,064,718 A 5/2000 Holland et al.
6,257,762 B1 7/2001 Guzik

* cited by examiner

*Primary Examiner*—Edward J. Glick
*Assistant Examiner*—Elizabeth Keaney
(74) *Attorney, Agent, or Firm*—Carl B. Horton, Esq.; Armstrong Teasdale LLP

(57) ABSTRACT

It is an object to provide an X-ray generating apparatus which permits easy alignment of an X-ray tube and easy insulation against high voltages. A screw through hole and pin through holes corresponding respectively to a screw hole and plural pin holes formed in an end face of a base portion of an X-ray tube are formed in an abutment face of a bracket against which the end face of the base portion of the X-ray tube comes into abutment, and a screw and plural pins are inserted respectively from the bracket side into the screw hole and plural pin holes in the X-ray tube through the screw through hole and the pin through holes, thereby mounting the X-ray tube to the bracket. The bracket is formed by an integral structure of FR 4.

8 Claims, 15 Drawing Sheets

FIG. 8 a (Zn) 2 ~ 4 %
b (Sn) 3.5 ~ 4.5 %
c (Ni) 1.5 ~ 2.5 %
d (Pb) 21 ~ 26 %
e (Cu) balance

FIG. 9 a (Zn) 2 %
b (Sn) 3.5 %
c (Ni) 1.5 %
d (Pb) 21 %
e (Cu) balance

FIG. 10 a (Zn) 4 %
b (Sn) 4.5 %
c (Ni) 2.5 %
d (Pb) 26 %
e (Cu) balance

| | a (W/m/C) | b (J/Kg/C) | c ($Kg/m^3$) |
|---|---|---|---|
| d | 391 | 385 | 8800 |
| e | 33 | 130 | 11400 |

a $10^7$ MΩ-cm
b $10^6$ MΩ-cm
c $3.1 \times 10^4$ V/mm
d >50KV

| | |
|---|---|
| a | 1.5 N/mm |
| b | 31.9/23.1 $KN/m^2$ |
| c | 0.17/0.16 |

X-RAY GENERATING APPARATUS

CROSS REFERENCE TO RELATED APPLICATIONS

This application claims the benefit of Japanese Application No. 2001-334149 filed Oct. 31, 2001.

BACKGROUND OF THE INVENTION

The present invention relates to an X-ray generating apparatus and more particularly to an X-ray generating apparatus using an X-ray tube.

In an X-ray generating apparatus using an X-ray tube, the X-ray tube is supported by a suitable support member. The support member supports the X-ray tube in such a manner that the focus of the X-ray tube coincides with a predetermined focal position in the X-ray generating apparatus. To this end, the mounting state, i.e., alignment, of the X-ray tube is adjusted.

The support member for supporting the X-ray tube is usually constructed of a metallic material. Since a high voltage of several ten kV or so is applied to the X-ray tube at the time of X-ray radiation, an insulating measure is able to withstand such a high voltage is applied to the support member.

In a certain type of an X-ray generating apparatus, for example in an X-ray generating apparatus of an integrate type in which an X-ray tube is accommodated within a single container together with a high voltage generating circuit, it is difficult to perform an X-ray tube alignment work, which is attributable to the structure of the apparatus. Moreover, since the material of the X-ray tube supporting member is metal, strict conditions are imposed on a measure for insulation.

SUMMARY OF THE INVENTION

Therefore, it is an object of the present invention to provide an X-ray generating apparatus which permits easy alignment of an X-ray tube and easy insulation against high voltages.

According to the present invention, for solving the above-mentioned problem, there is provided an X-ray generating apparatus comprising an X-ray tube having a base portion, the base portion having a single screw hole and a plurality of pin holes, the screw hole and the pin holes being formed perpendicularly to an end face of the base portion; a bracket formed by an integral structure of an epoxy laminated glass cloth sheet, the bracket having an abutment face against which the end face of the base portion of the X-ray tube comes into abutment, a screw through hole formed correspondingly to the screw hole and perpendicularly to the abutment face, the screw through hole permitting a screw for threaded engagement with the screw hole to pass therethrough, a plurality of pin through holes formed correspondingly to the plural pin holes and perpendicularly to the abutment face, the pin through holes having the same diameter as the diameter of the corresponding pin holes and permitting pins for insertion into the pin holes to pass therethrough, and a base portion formed in a position spaced in an extending direction of the abutment face from the position where the screw through hole is formed; a screw which is brought into threaded engagement into the screw hole formed in the base portion of the X-ray tube through the screw through hole from the side opposite to the abutment face in the bracket; a plurality of pins which are inserted respectively into the plural pin holes formed in the base portion of the X-ray tube through the plural pin through holes from the side opposite to the abutment face in the bracket; and a substrate to which the base portion of the bracket is mounted.

Thus, in the present invention, a screw through hole and pin through holes, which correspond respectively to a screw hole and plural pin holes formed in an end face of a base portion of an X-ray tube, are formed in an abutment face of a bracket against which the end face of the base portion of the X-ray tube comes into abutment, and a screw and plural pins are inserted into the screw hole and plural pin holes formed in the X-ray tube from the bracket side through the screw through hole and the pin through holes, thereby mounting the X-ray tube to the bracket. Therefore, a positional relation of the X-ray tube to the bracket is established naturally by the plural pins. Besides, since the bracket is formed by an integral structure of an epoxy laminated glass cloth sheet, there is made insulation against high voltages effectively.

For supporting the X-ray tube while keeping the tube spaced a certain distance from the surface of the substrate, it is preferable that the base portion of the bracket have an abutment face for abutment against the substrate and that an extending direction of the abutment face be perpendicular to the extending direction of the abutment face against which the end face of the base portion of the X-ray tube comes into abutment.

For enlarging a creeping distance from the abutment portion of the X-ray tube to the base portion thereof it is preferable that the bracket be bent at substantially right angles at the portion thereof located between the abutment face against which the end face of the base portion of the X-ray tube comes into abutment and the base portion of the bracket.

For preventing offset in the arrangement of pin holes it is preferable that the plural pin holes include two pin holes formed in a pair on mutually opposite sides with respect to the screw hole.

For well-balancing the arrangement of pin holes it is preferable that the two pin holes formed in a pair be positioned symmetrically with respect to the screw hole.

For well-balancing the arrangement of all the pin holes it is preferable that the plural pin holes be positioned at equal intervals on a circumference centered at the screw hole.

For effecting a highly accurate positional control with a reduced number of pins it is preferable that the number of the plural pin holes be four.

For supporting the X-ray tube so that the axis thereof is perpendicular to the abutment face of the bracket, it is preferable that the end face of the base portion of the X-ray tube be perpendicular to the axis of the X-ray tube.

According to the present invention, there can be provided an X-ray generating apparatus which permits easy alignment of an X-ray tube and easy insulation against high voltages.

Further objects and advantages of the present invention will be apparent from the following description of the preferred embodiments of the invention as illustrated in the accompanying drawings.

BRIEF DESCRIPTION OF THE DRAWINGS

FIG. 8 is a diagram showing a composition of a copper alloy;

FIG. 9 is a diagram showing a composition of a copper alloy;

FIG. 10 is a diagram showing a composition of a copper alloy;

DETAILED DESCRIPTION OF THE INVENTION

Figure 1:
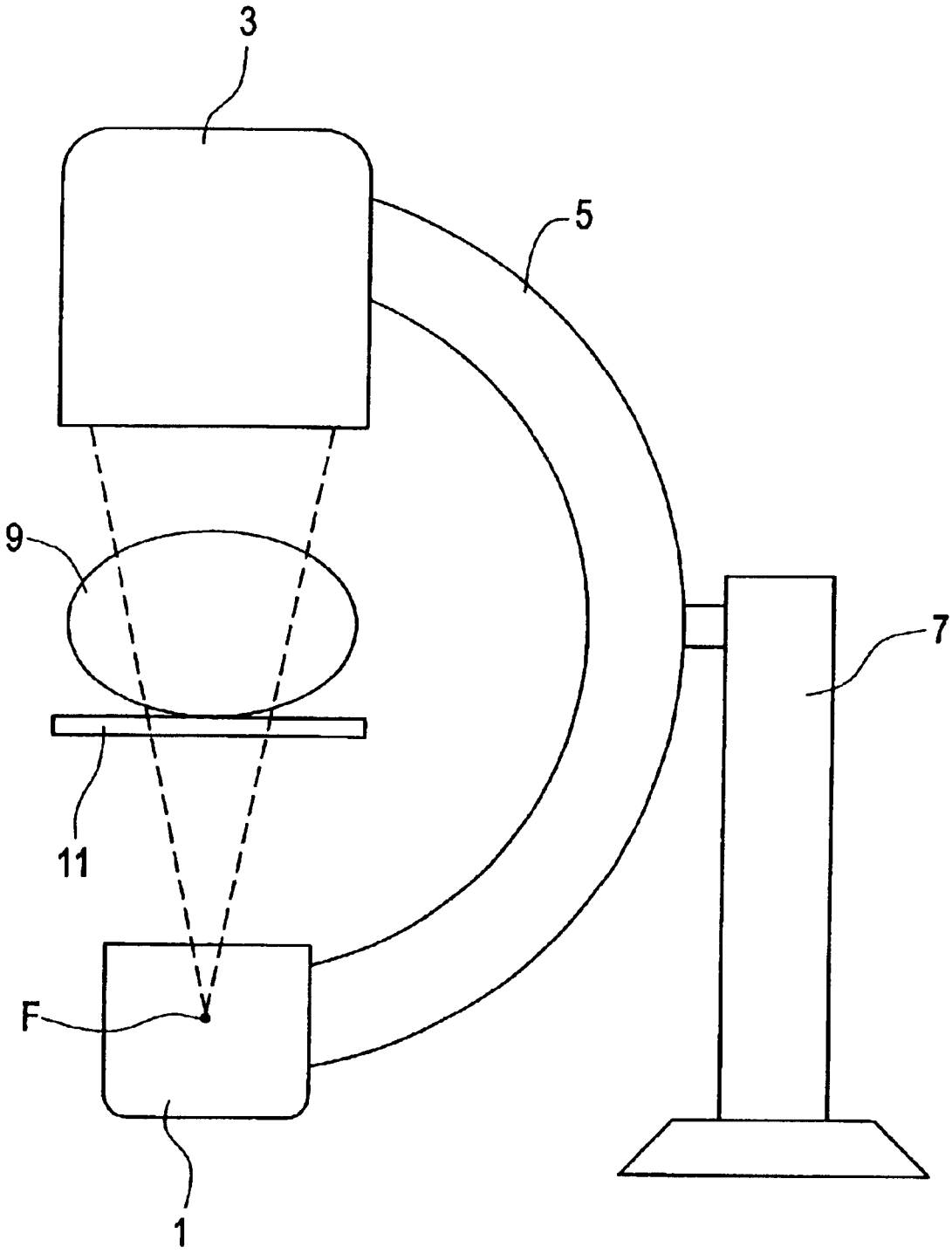
FIG. 1 is a schematic construction diagram of an X-ray radiating/detecting system.

An embodiment of the present invention will now be described in detail with reference to the accompanying drawings, provided the invention is not limited to the embodiment. FIG. 1 shows a schematic construction of an X-ray radiating/detecting system for use in X-ray radiographic inspection equipment. As shown in the same figure, in the X-ray radiating/detecting system, a radiating unit 1 and a detecting unit 3 are supported respectively by both ends of a C-shaped support arm 5 and are opposed to each other through a space. The support arm 5 is supported by a stand 7.

An object 9 to be seen through, which is placed on a cradle 11, is carried into the space between the radiating unit 1 and the detecting unit 3. As indicated with broken lines, the radiating unit 1, which contains an X-ray tube, radiates a conical X-ray beam emitted from an X-ray F to the object 9. X-ray which has passed through the object 9 is detected by the detecting unit 3. An X-ray generating apparatus according to an embodiment of the present invention to be described below is used, for example, as the radiating unit 1 in such an X-ray radiating/detecting system.

Figure 2:
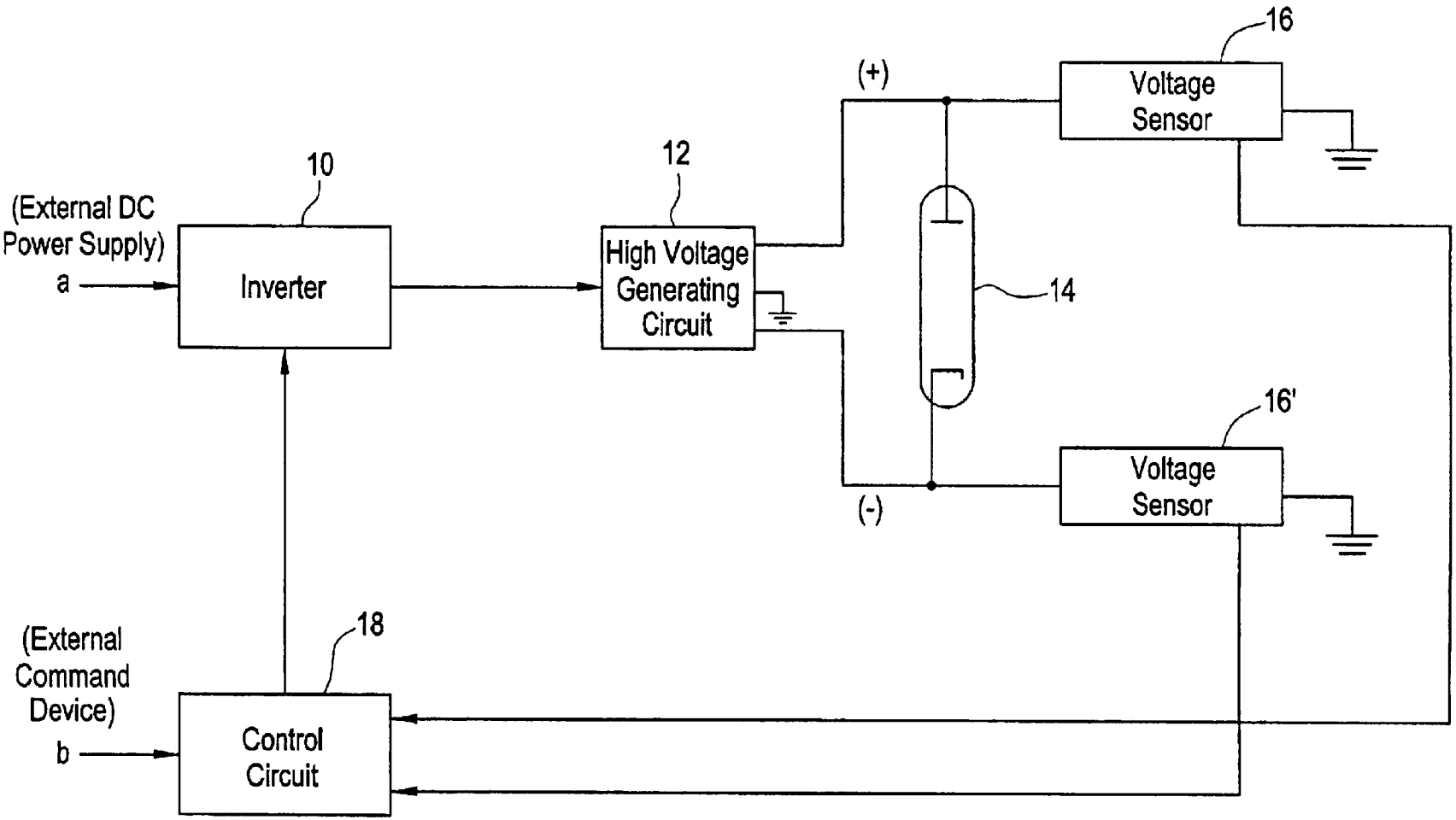
FIG. 2 is a block diagram showing an electrical configuration of an X-ray generating apparatus.

FIG. 2 is a block diagram showing an electrical configuration of the X-ray generating apparatus. As shown in the same figure, the X-ray generating apparatus has an inverter 10. The inverter 10 converts a direct current provided from an external DC power supply (not shown) to an alternating current having a frequency of, say, several ten kHz and inputs the alternating current to a high voltage generating circuit 12. The high voltage generating circuit 12 steps up and rectifies the inputted alternating current with use of a transformer and generates a pair of positive and negative DC high voltages, which are, for example, +60 kV and −60 kV. The positive DC high voltage is applied to an anode of an X-ray tube 14, while the negative DC high voltage is applied to a cathode of the X-ray tube 14. As a result, a voltage of, for example, 120 kV is applied between the anode and the cathode.

Anode voltage and cathode voltage are detected by voltage sensors 16 and 16', respectively, and are fed back to a control circuit 18. The control circuit 18 controls the inverter 10 so that the anode voltage and the cathode voltage become respective predetermined voltages. A control command is provided to the control circuit 18 from an external command device (not shown). Under the control command the control circuit 18 makes an X-ray irradiation control.

Figure 3:
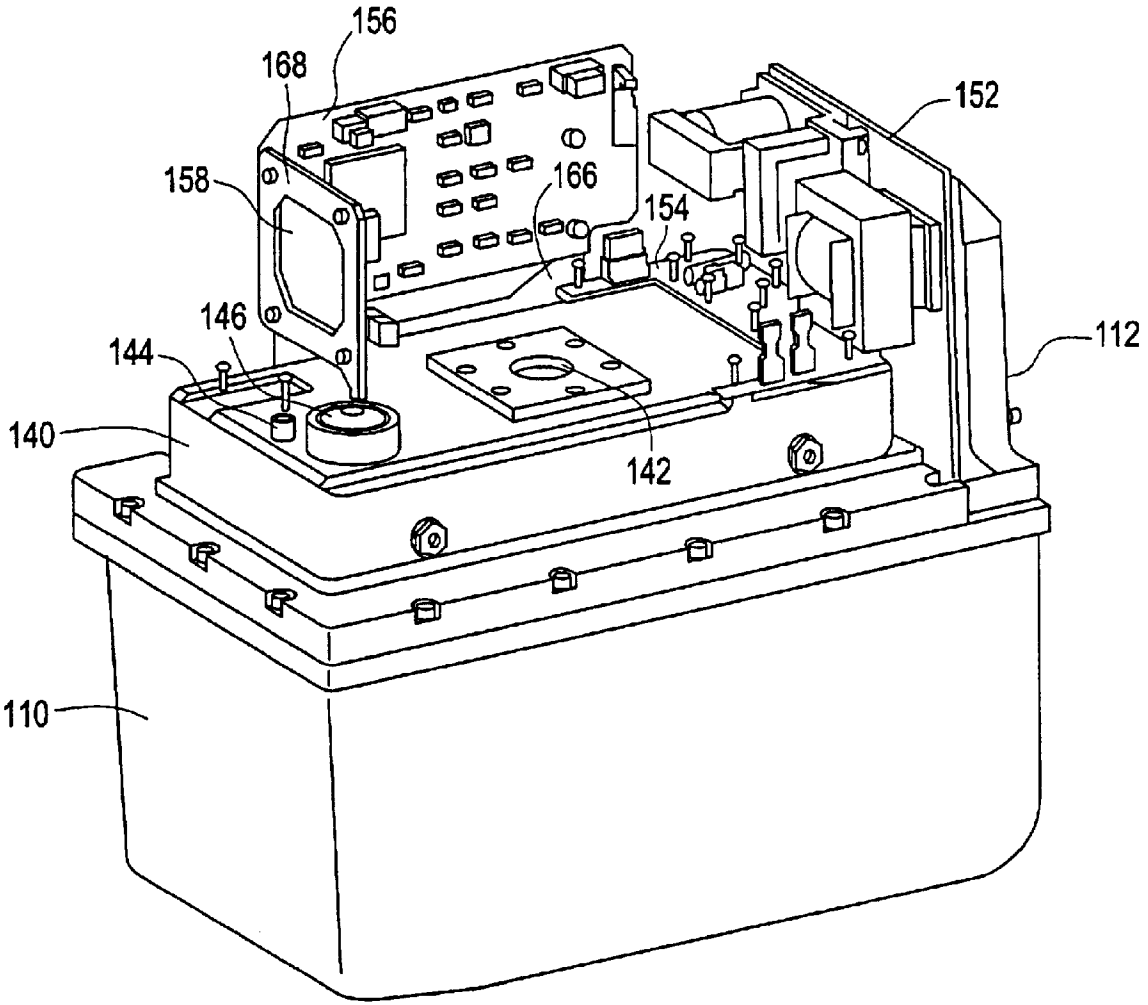
FIG. 3 is a schematic diagram showing an appearance of the X-ray generating apparatus.
Figure 4:
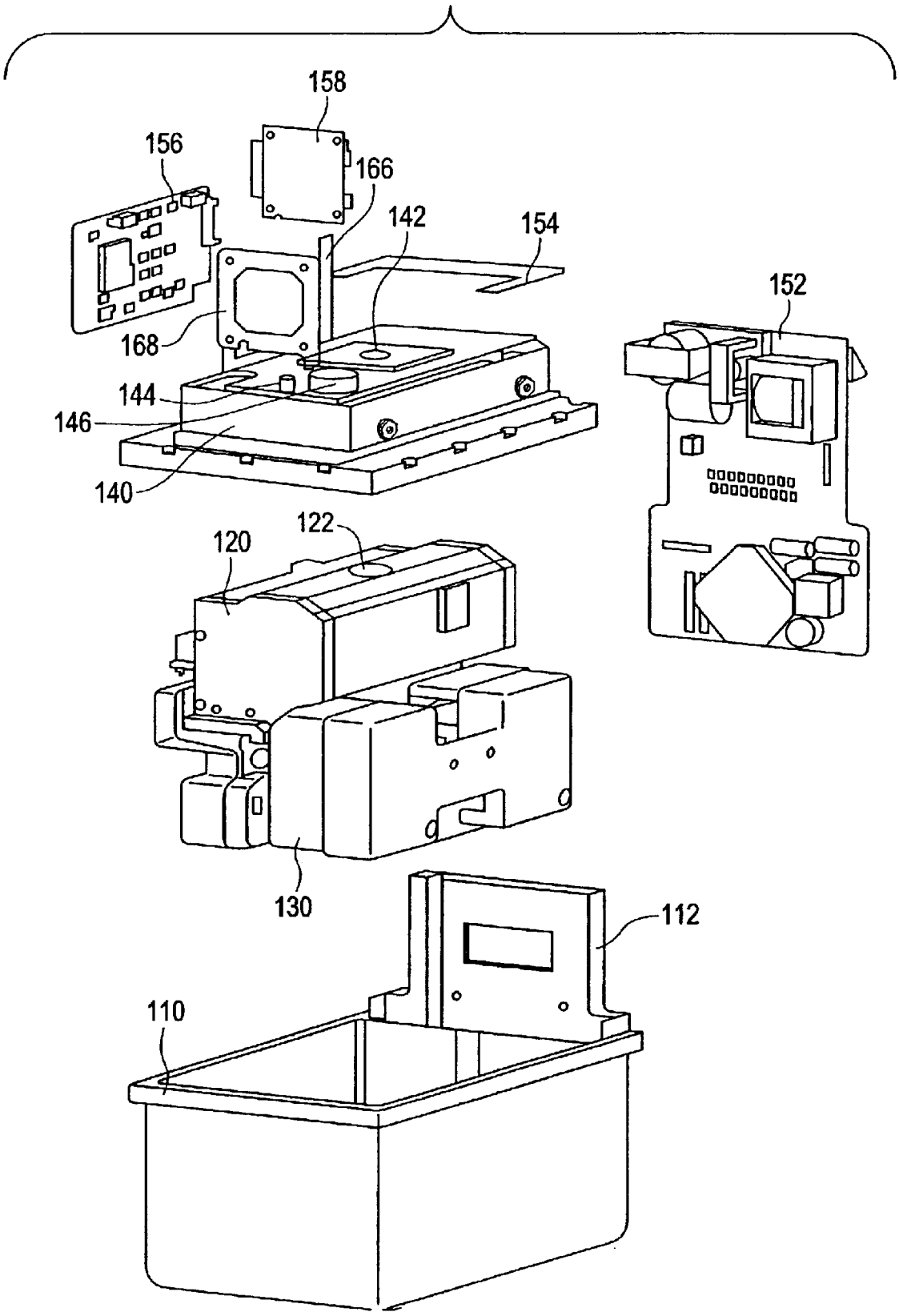
FIG. 4 is a schematic exploded diagram of the X-ray generating apparatus.

FIG. 3 is a schematic diagram showing an appearance of the X-ray generating apparatus, with an upper cover removed. FIG. 4 illustrates the apparatus in an exploded state into components. The present invention is embodied by the illustrated construction.

As shown in both figures, the X-ray generating apparatus of this embodiment has a case 110. The case 110 is a generally rectangular metal case whose upper portion is open largely. As the metal there is used an aluminum (Al) alloy for example. The case 110 has an extension wall 112 formed by extending one side wall upward. The side wall where the extension wall 112 is formed is a double wall.

An X-ray tube container 120 and a high voltage unit 130 are installed within the case 110 in such a manner that the X-ray tube container 120 overlies the high voltage unit 130. The X-ray tube container 120 contains the X-ray tube. The high voltage unit 130 supplies an anode-to-cathode voltage to the X-ray tube in the X-ray tube container 120. An outside of the high voltage unit 130 is covered with an electric insulating material to ensure insulation between it and an inner surface of the case 110. In the high voltage unit 130 are included the high voltage generating circuit 12 and the voltage sensors 16 and 16' which are shown in FIG. 2. Also included therein is a circuit for the supply of a filament current to the X-ray tube.

The X-ray tube container 120 has an aperture 122 formed in an upper surface thereof for the emission of X-ray. The X-ray tube container 120 is constituted by a material which does not transmit X-ray, that is, X-ray is emitted from nowhere except the aperture 122. As to the construction and material of the X-ray tube container 120 and an X-ray tube supporting mechanism installed within the X-ray tube container 120, they will be described again later.

With the X-ray tube container 120 and the high voltage unit 130 received within the case 110, the opening of the case is hermetically sealed with a lid 140. The lid 140 has an X-ray exit window 142 in a position corresponding to the aperture 122 of the X-ray tube container 120. The X-ray exit window is hermetically sealed with a thin plate which can transmit X-ray. As the material of the thin plate there is used aluminum for example.

The case 110, in the hermetically sealed state, is filled with an electrically insulating liquid such as oil for example. The liquid which has thus poured into the case is also filled into the X-ray tube container 120 through the aperture 122. The filling of liquid is performed through an inlet port 144 formed in the lid 140. The inlet port has a check valve so that the liquid once poured into the interior does not leak to the exterior.

The lid 140 is provided with bellows 146 for absorbing a temperature expansion of the interior liquid. The bellows 146 is a small-sized vessel whose volume changes according to expansion and contraction of the interior liquid.

A circuit board 152 is mounted on an inner surface of the extension wall 112 in a state where a lower half of the circuit board is inserted between both walls of the double wall of the case 110. The circuit of the inverter 10 shown in FIG. 2 is formed on the circuit board 152. Connection of the inverter 10 and the high voltage generating circuit 12 is made through an electric path (not shown) which extends through the lid 140 in a liquid-tight manner.

Circuit boards 154, 156, and 158 are mounted on the lid 140. The circuit board 154 is mounted on an upper surface of the lid 140 so that the board surface thereof is parallel to the lid upper surface while avoiding the X-ray exit window 142. The circuit boards 156 and 158 are mounted at peripheral positions through support members 166, 168 on the upper surface of the lid 140 so as to be perpendicular to the lid upper surface. All of the circuit boards 152 to 158 are mounted at positions where X-ray emitted from the X-ray exit window 42 does not pass those circuit boards.

The control circuit 18 is formed dividedly according to suitable functions on the circuit boards 154, 156, and 158. Connection between the control circuit 18 and the voltage sensors 16, 16' is conducted through an electric path (not shown) which extends through the lid 140 in a liquid-tight manner.

Figure 5:
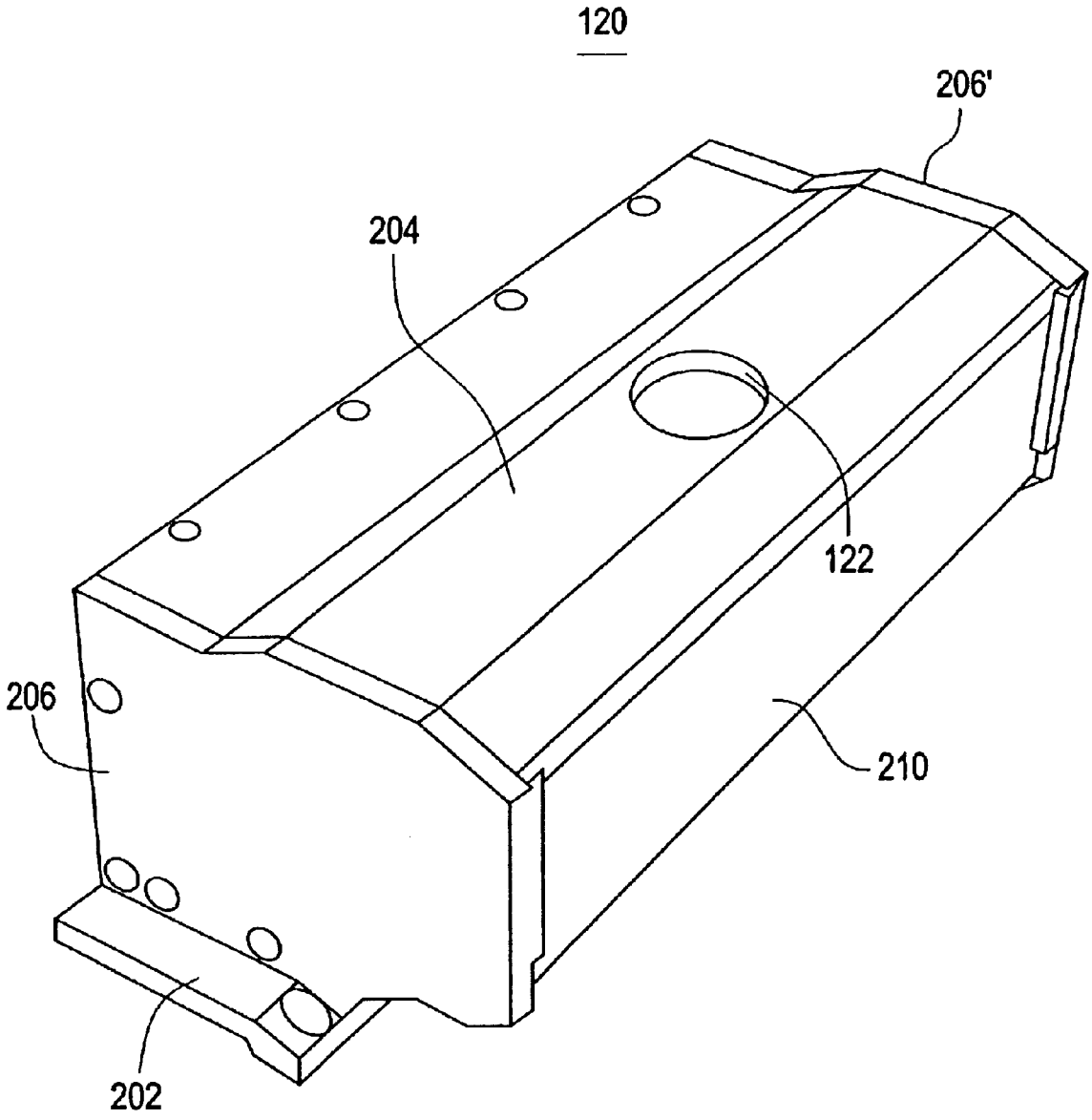
FIG. 5 is a schematic diagram showing an appearance of an X-ray tube container.
Figure 6:
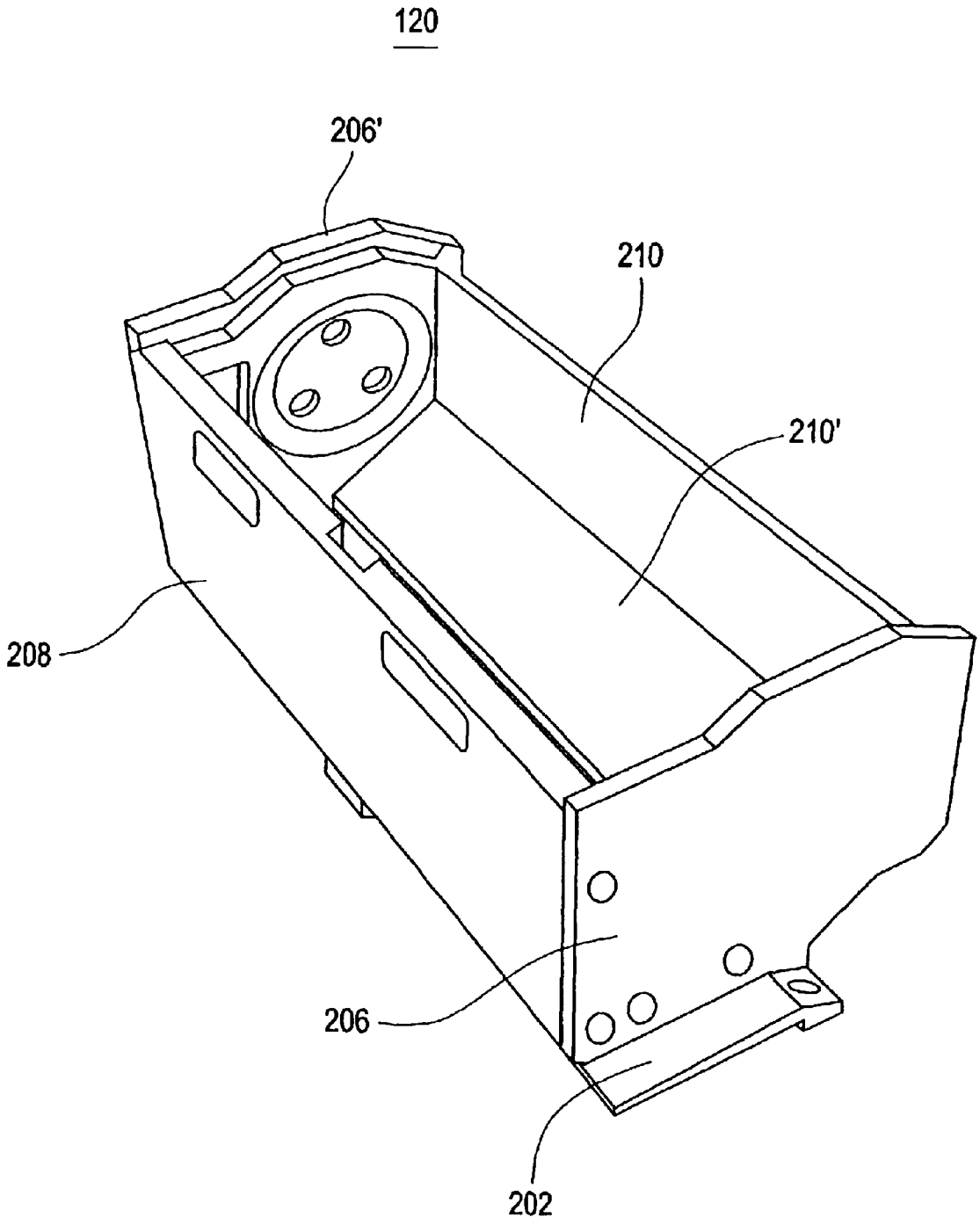
FIG. 6 is a schematic diagram showing an appearance of the X-ray tube container in a partially cut-away condition.

FIGS. 5 and 6 are schematic diagrams showing appearances of the X-ray tube container 120 as seen in two directions. The appearance shown in FIG. 6 is with an upper plate and the X-ray tube removed. As shown in both figures, the X-ray tube container 120 is a generally rectangular box-shaped container and is constituted by a combination of a bottom plate 202, an upper plate 204, end plates 206, 206', and side plates 208, 210, 210'. The aperture 122 for the emission of X-ray is formed in the upper plate 204.

The bottom plate 202 constitutes a base of the X-ray tube container 120. The end plates 206 and 206' are mounted respectively on both end portions of the bottom plate 202 so as to be opposed to each other and perpendicular to an upper surface of the bottom plate. For example, the mounting is performed with screws, as will also be the case in the following. Between the end plates 206 and 206' is mounted a side plate 208 along one side of the bottom plate 202 and perpendicularly to the upper surface of the bottom plate and to plate surfaces of the end plates 206, 206', while along the opposite side of the bottom plate 202 are mounted side plates 210 and 210' perpendicularly to the end plates 206 and 206' so that the side plate 210 overlies the side plate 210'.

Mounting of the side plates 210 and 210' to the end plates 206 and 206' is performed, for example, by fitting both ends of the side plates 210 and 210' into grooves formed in the end plates 206 and 206'. The side plate 210 is perpendicular to the bottom plate 202 and the side plate 210' has an inclination toward the bottom plate 202. The side plates 210 and 210' are connected together vertically and constitute an outwardly bent side wall of the X-ray tube container 120. The upper plate 204 closes from above an opening which is defined by edges of the end plates 206, 206' and side plates 208, 210.

Figure 7:
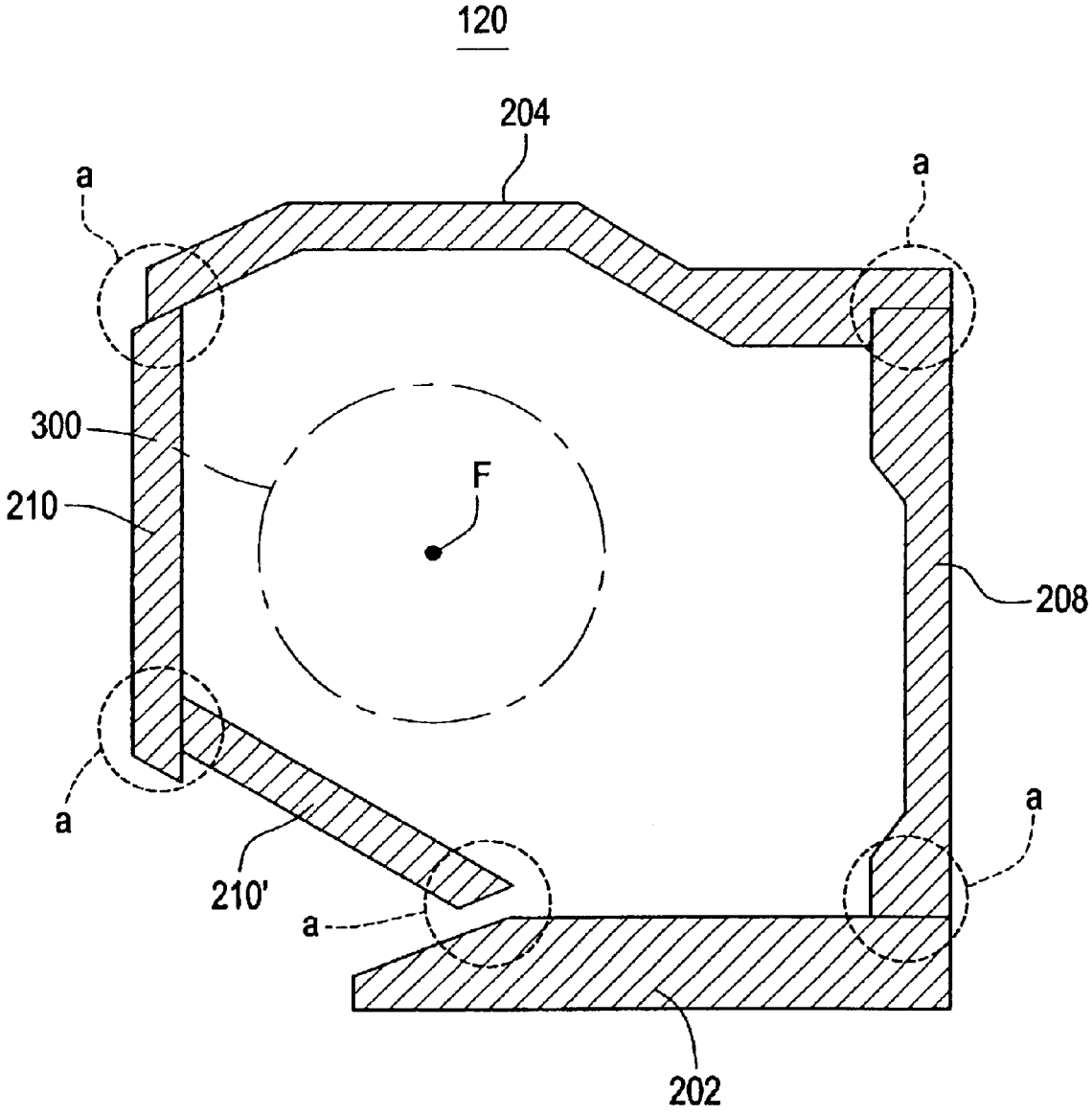
FIG. 7 is a schematic diagram showing a cross section of the X-ray tube container.

FIG. 7 illustrates a cross section of the X-ray tube container 120. A dot-dash line circle in the same figure represents an outer periphery surface of an X-ray tube 300 which is installed in the interior of the X-ray tube container 120 and which will be described later. Of the bottom plate 202, upper plate 204 and side plates 208, 210, 210', the side plates 210 and 210' are shorter in the distance from the outer periphery surface of the X-ray tube than the other plates.

As the material of the bottom plate 202, upper plate 204, end plates 206, 206' and side plate 208 there is used a copper alloy with lead incorporated therein. FIG. 8 shows a composition of such a copper alloy. As shown in the same figure, the proportions of components are zinc (Zn) 2–4%, tin (Sn) 3.5–4.5%, nickel (Ni) 1.5–2.5%, lead (Pb) 21–26%, and the balance copper (Cu). FIG. 9 shows a composition of a copper alloy with the proportion of lead set at 21%, while FIG. 10 shows a composition of a copper alloy with the proportion of lead set at 26%.

A 6 mm thick plate formed by a copper alloy of any of such compositions possesses X-ray shieldability equivalent to that of a 2 mm thick lead plate and thus can be utilized as an X-ray shielding material in place of lead.

Figures 11, 12, 13:
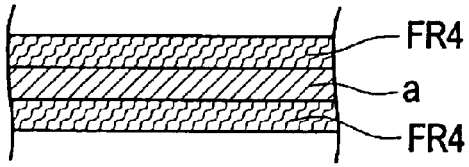
FIG. 11 is a diagram showing constants of brass in comparison with lead.
FIG. 12 is a schematic diagram showing a section of a composite material of FR4 and lead.
FIG. 13 is a diagram showing constants of FR4.

Further, such a copper alloy possesses thermal conductivity, specific heat and density which are equivalent to those of brass. FIG. 11 shows those characteristics in comparison with those of brass. As shown in the same figure, the thermal conductivity, specific heat, and density of brass are respectively about ten, three, and eight times those of brass.

Therefore, by constituting the bottom plate 202, upper plate 204, end plates 206, 206' and side plate 208 of the X-ray tube container 120 with use of the above copper alloy, there can be obtained an X-ray tube container possessing X-ray shieldability equivalent to that of lead and superior in thermal conductivity to lead.

As the material of the side plates 210 and 210' there is used a composite material of an epoxy laminated glass cloth sheet and lead. In the technical field concerned, the epoxy laminated glass cloth sheet is also called FR4. Therefore, the epoxy laminated glass cloth sheet will hereinafter be also referred to as FR4.

For example, as shown in FIG. 12, the composite material of FR4 and lead has a three-layer structure comprising an intermediate layer of lead and upper and lower layers of FR4 with respect to the intermediate layer. The side plates 210 and 210' are each constituted by a plate of such a composite material having a lead portion thickness of 2 mm.

FR4, whose electrical constants are shown in FIG. 13, possesses an excellent electrical insulating property and is therefore suitable as the material of container walls positioned close to the X-ray tube. By thus disposing container walls in close proximity to the X-ray tube, it becomes possible to so much reduce the size of the X-ray tube container 120. Although FR4 itself does not possess X-ray shieldability, it becomes possible to shield X-ray by using a composite material including lead as an intermediate layer.

The side plates 210 and 210' may also be constituted by the above copper alloy in the case where there is a sufficient distance from the outer periphery surface of the X-ray tube to the side plates 210 and 210' as is the case with the other plates.

As indicated in a circled state with broken lines in FIG. 7, with respect to the bottom plate 202, upper plate 204 and side plates 208, 210, 210', there exist opposed portions between adjacent plates. Though not shown in the same figure, it is of course that also with respect to the end plates 206 and 206' there exist opposed portions between them and other plates.

In each of those opposed portions, two adjacent plates are disposed so that their opposed faces intersect the direction of X-ray radiated from the focus F of the X-ray tube. More specifically, the opposed faces of two adjacent plates in each of the opposed portions are not parallel to the radiating direction of X-ray, so there is no fear of X-ray leaking to the exterior from the gap between the opposed faces of two adjacent plates.

Since the X-ray tube container 120 has such construction and material as described above, the X-ray radiated from the X-ray tube is all shielded except the X-ray which is emitted from the aperture 122. Since the X-ray tube 300 is accommodated within such an X-ray tube container 120, there no longer is the necessity of affixing a lead plate to the outer periphery surface of the X-ray tube 300 with use of an epoxy resin as in the prior art.

Consequently, the heat of the X-ray tube is transmitted efficiently to the surrounding liquid. The heat of the liquid is transmitted to the outside liquid through the constituent plates of the X-ray tube container 120 which plates are superior in thermal conductivity, and is further radiated to the exterior through the case 110. In this way it is possible to effect the radiation of heat from the X-ray tube efficiently. Since the heat radiation from the X-ray tube is thus efficient, the rate of temperature rise of this apparatus becomes small, so that it is possible to prolong a continuously operable time.

Figure 14:
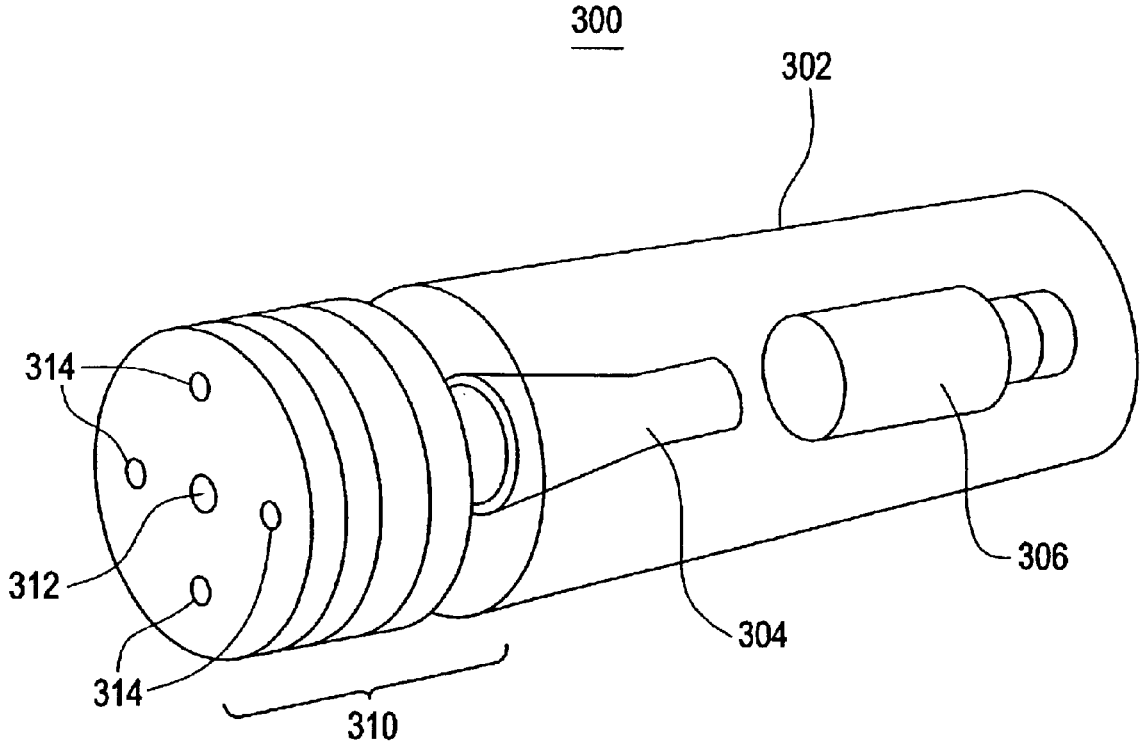
FIG. 14 is a schematic diagram showing an appearance of an X-ray tube.

FIG. 14 schematically illustrates an appearance of the X-ray tube 300. As shown in the same figure, the X-ray tube 300, which is generally cylindrical in external form, is provided with an anode 304 and a cathode 306 within a cylindrical, transparent tube body 302 closed at both ends.

The X-ray tube 300 is further provided with a base portion 310 at an anode-side end of the tube body 302. In an end face of the base portion 310, which end face is a plane perpendicular to the axis of the X-ray tube, there are formed a screw hole 312 and plural pin holes 314 perpendicularly to the end face. All of these holes are bottomed holes.

The screw hole 312 is formed centrally of the end face, while the plural pin holes 314 are formed in a decentralized fashion around the screw hole 312. Although the number of pin holes 314 shown in the figure is four, it is not limited to four, but may be any other plural number.

The four pin holes 314 are arranged at equal intervals on a circumference centered at the screw hole 312 so as to be positioned symmetrically on opposite sides two pin holes by two pin holes with respect to the screw hole 312. The arrangement of the plural pin holes 314 is not limited to this arrangement, but any other suitable arrangement may be adopted.

Figure 15:
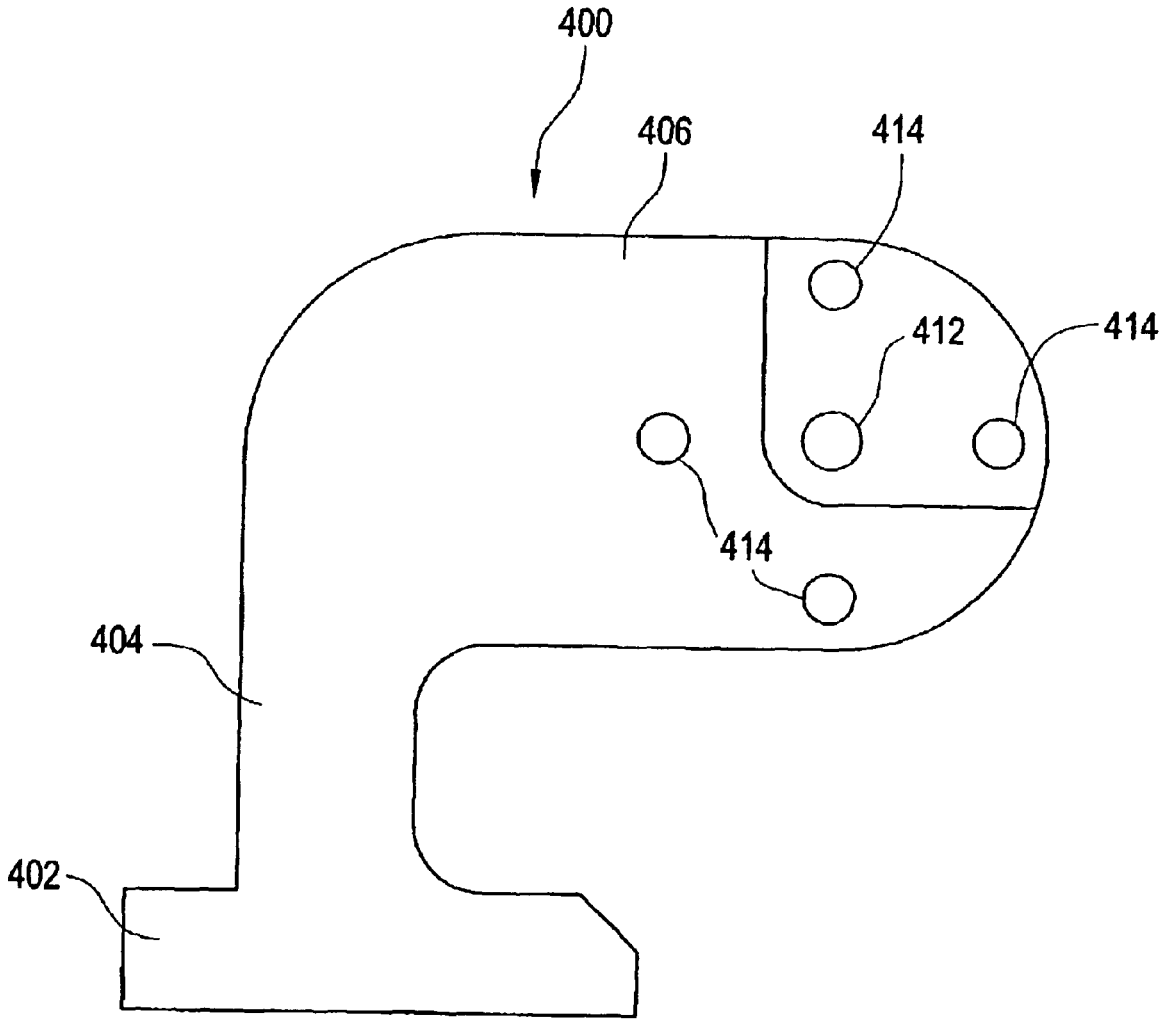
FIG. 15 is an elevation of a bracket.
Figure 16:
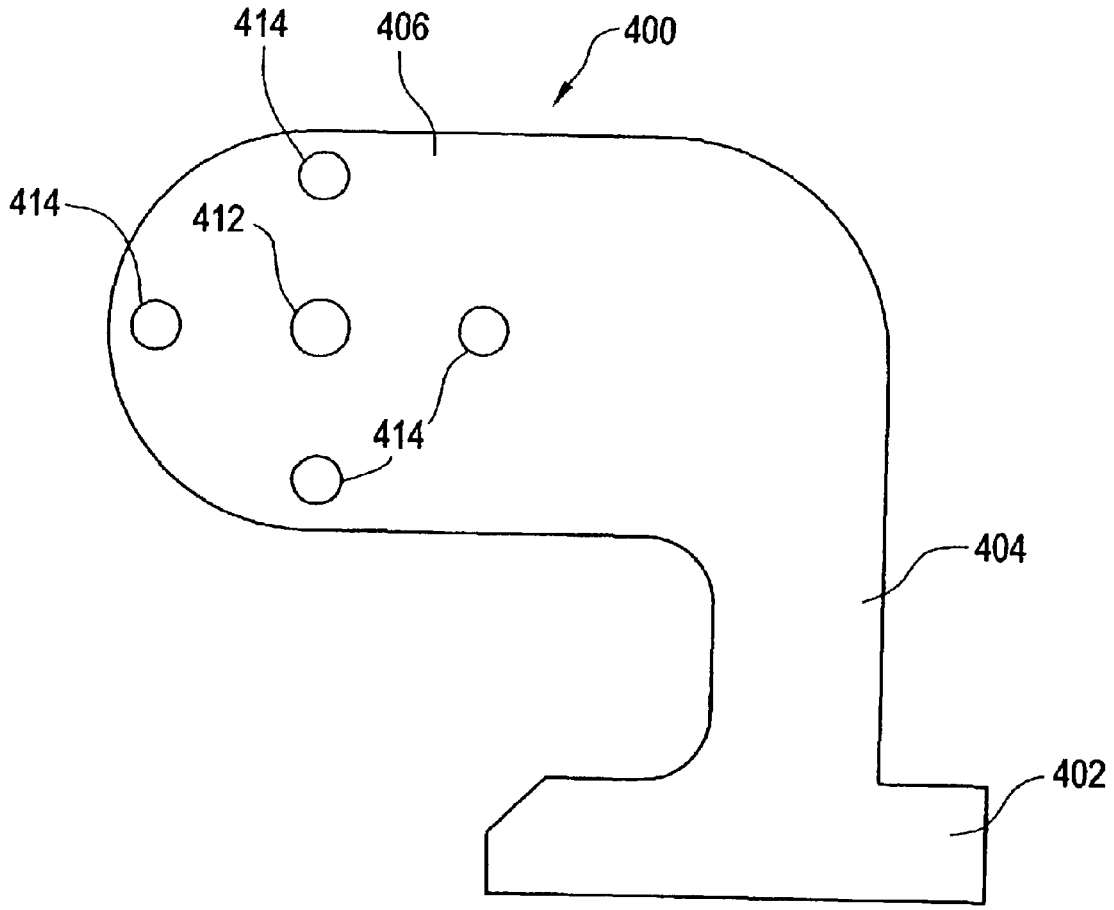
FIG. 16 is an elevation of the bracket.
Figures 17, 18:
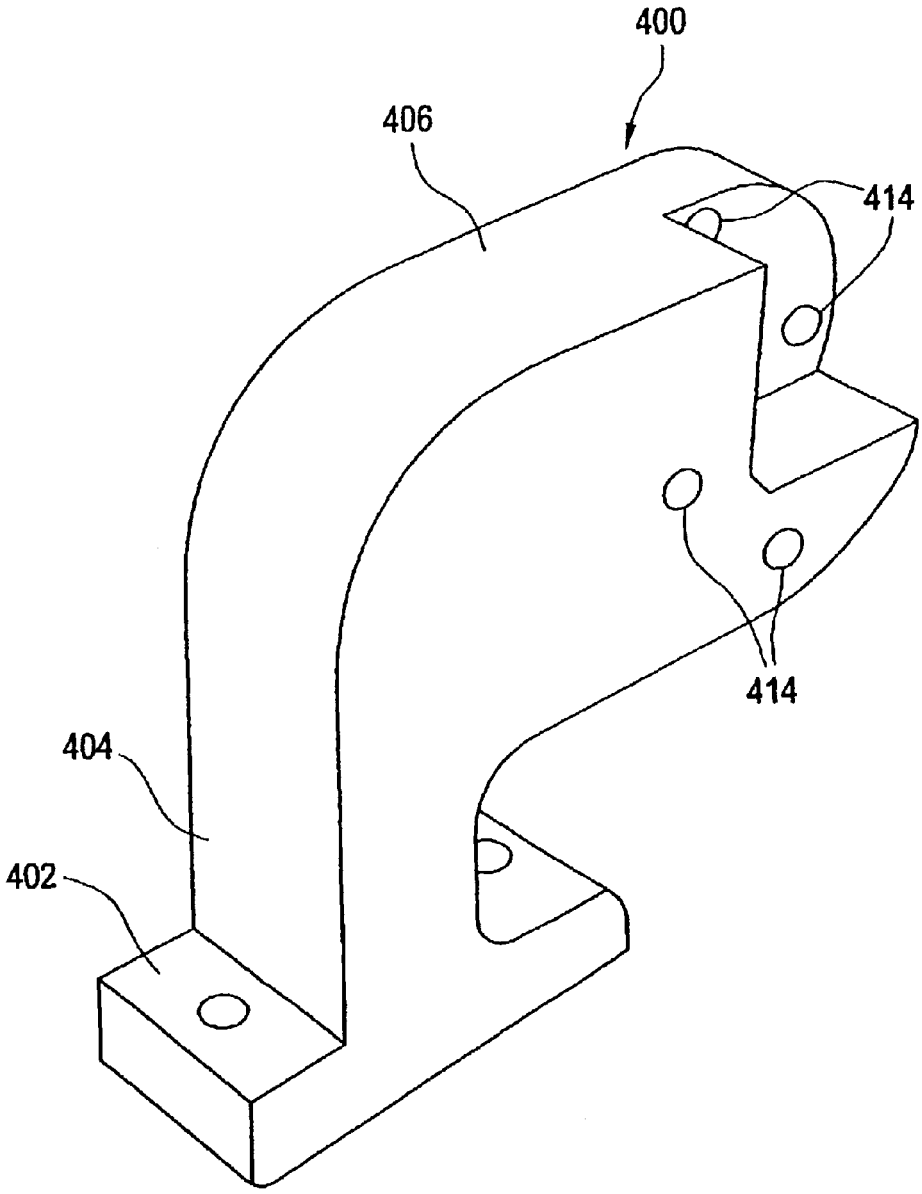
FIG. 17 is a perspective view of the bracket.
FIG. 18 is a diagram showing constants of FR4.

FIGS. 15, 16, and 17 illustrate the construction of a bracket 400 which is used for supporting the X-ray tube 300 within the X-ray tube container 120, of which FIGS. 15 and 16 are elevations of sides opposite to each other and FIG. 17 is a perspective view.

As shown in these figures, the bracket 400 has a cross arm-like structure which is bent at substantially right angles. To be more specific, the bracket 400 comprises a vertical arm 404 rising vertically from a base portion 402 and a horizontal arm 406 extending horizontally from the vertical arm 404. A screw through hole 412 and plural pin through holes 414 are formed in a portion close to a front end of the horizontal arm 406. These through holes extend in a direction perpendicular to the extending directions of the vertical arm 404 and horizontal arm 406.

The screw through hole 412 corresponds to the screw hole 312 formed in the base portion 310 of the X-ray tube 300 and has an inside diameter which permits the insertion therethrough of a screw inserted into the screw hole 312. The plural pin through holes 414 correspond to the plural pin holes 314 formed in the base portion 310 of the X-ray tube 300 and have the same inside diameter as that of the pin holes 314.

The front end of the horizontal arm 406 is partially cut out from one side and its thickness is reduced in that cutout portion. The screw through hole 412 and two pin through holes 414 are formed in this reduced-thickness portion. The side face on the side not partially cut out is a plane as shown in FIG. 16. The end face of the base portion 310 of the X-ray tube 300 comes into abutment against the plane as will be described later.

The material which constitutes the bracket 400 is FR4. FR4 is superior in electrical insulating property as noted earlier; besides, it possesses excellent properties as a structural material as is seen from mechanical constants thereof shown in FIG. 18.

Figure 19:
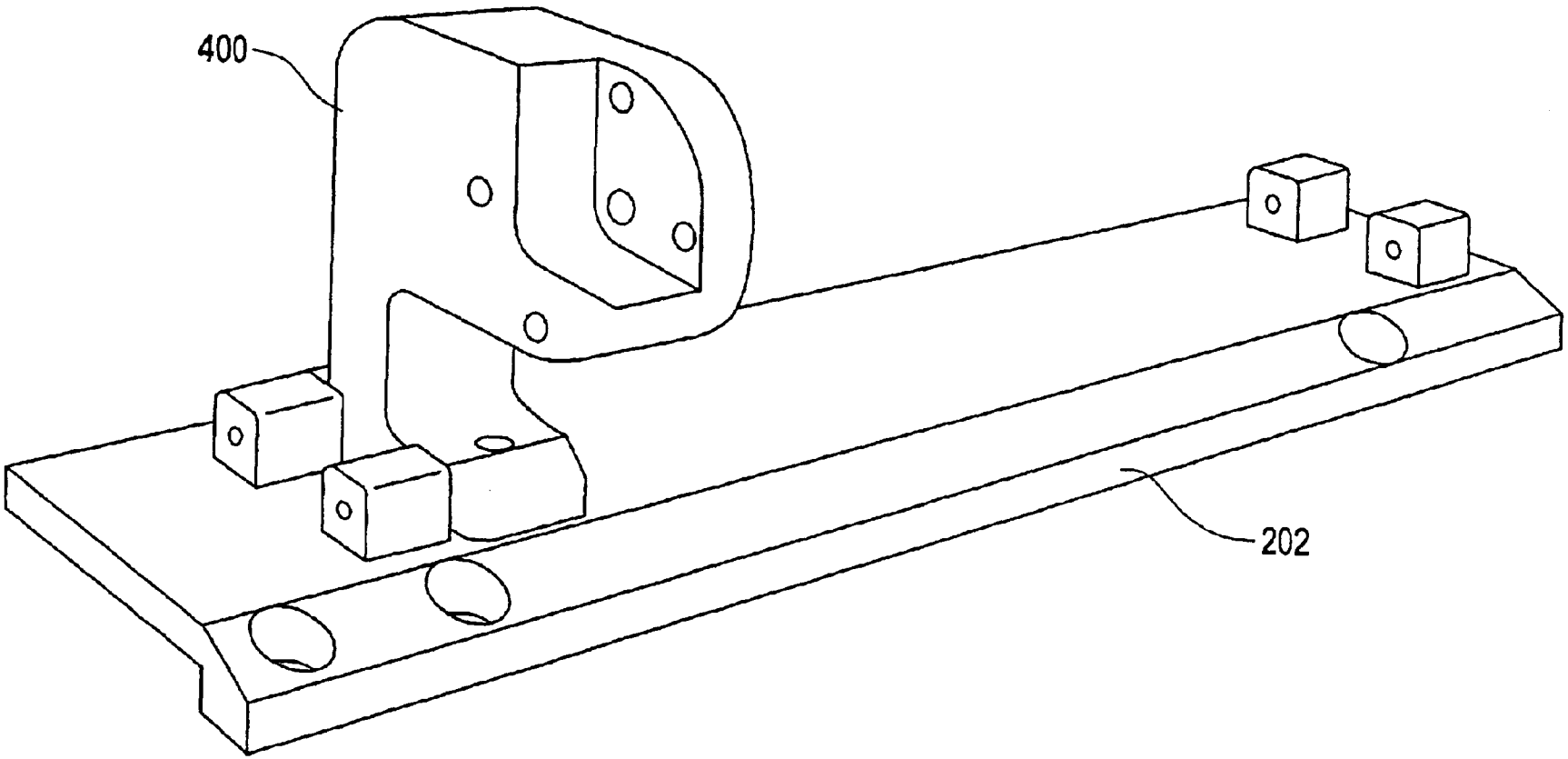
FIG. 19 is a schematic diagram showing a mounted state of the bracket to a bottom plate.

As shown in FIG. 19, the bracket 400 thus constructed is mounted to the upper surface of the bottom plate 202 of the X-ray tube container 120. More specifically, with the bottom of the base portion 402 of the bracket 400 abutted against the upper surface of the bottom plate 202, the bracket 400 is mounted to the upper surface of the bottom plate 202 with screws or the like at a predetermined position close to one end of the bottom plate. The bracket 400 is mounted such that its cutout side face faces the end side of the bottom plate 202.

Figure 20:
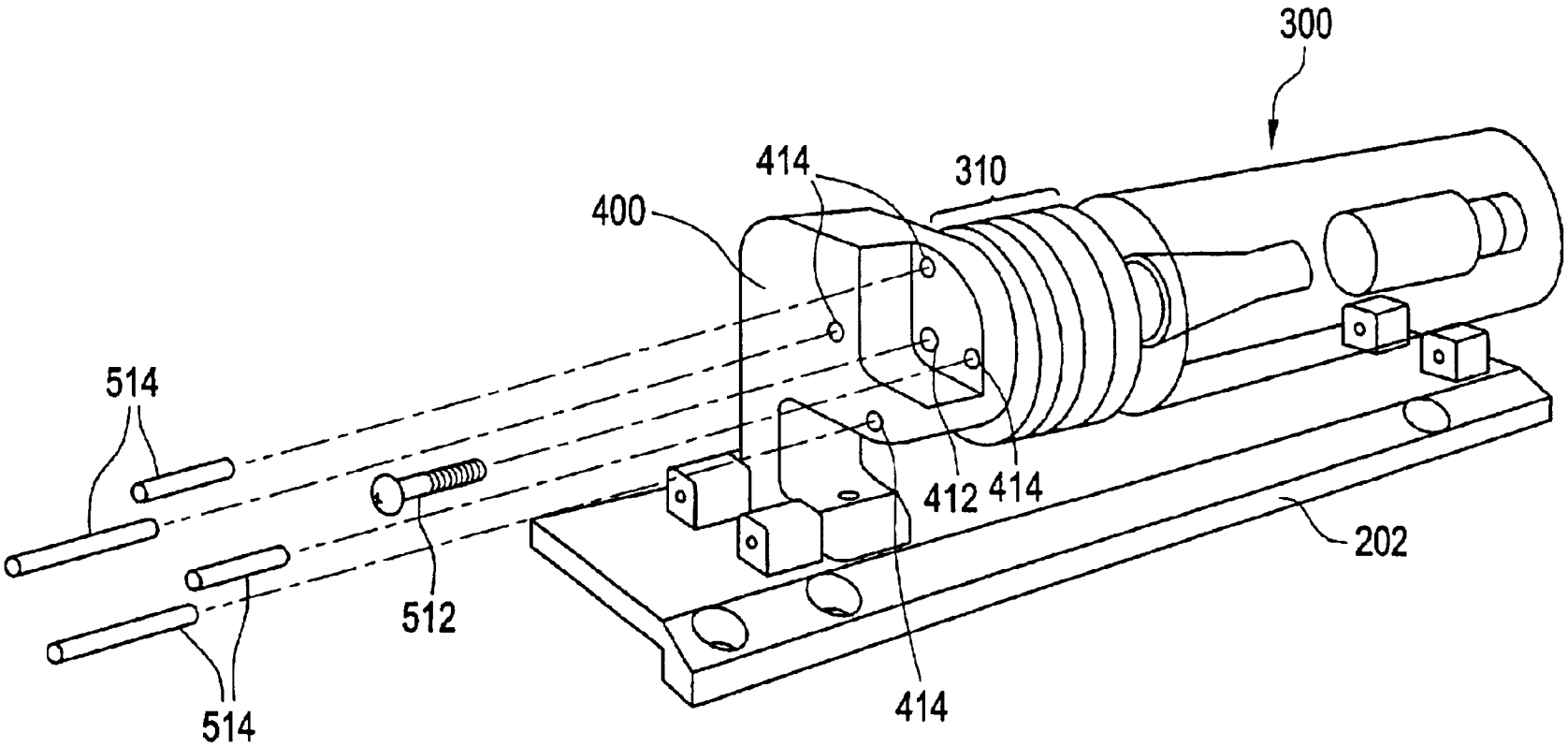
FIG. 20 is a schematic diagram showing a mounted state of the X-ray tube to the bracket.

In mounting the X-ray tube 300 to the bracket 400, the X-ray tube 300 is brought into abutment against the bracket 400, as shown in FIG. 20. At this time, the screw hole and plural pin holes formed in the base portion 310 of the X-ray tube 300 are put in abutment correspondingly against the screw through hole 412 and plural pin through holes 414.

Then, from the bracket 400 side, a screw 512 is inserted through the screw through hole 412 into the screw hole 312 formed in the X-ray tube 300, allowing the X-ray tube 300 to be temporarily fixed to the bracket 400 in a state in which the screw 512 is not tightened to a complete extent. In this state, from the bracket 400 side, plural pins 514 are inserted respectively through the plural pin through holes 414 into the plural pin holes 314 formed in the X-ray tube 300.

The pins 514 have an outside diameter which fits tightly in the inside diameter of the pin through holes 414 and that of the pin holes 314. By inserting such pins 514 into the pin holes 314 through the pin through holes 414, a positional relation of the X-ray tube 300 to the bracket 400 is determined in a unitary manner and with a high accuracy. Thereafter, the screw 512 is tightened to a complete extent to fix the X-ray tube 300 to the bracket 400.

Thus, since the positional relation of the X-ray tube 300 to the bracket 400, i.e., alignment, is controlled in a unitary manner and with a high accuracy in the mounting stage of the X-ray tube 300 by the pins 514, pin through holes 414 and pin holes 314, it is no longer required to make such an alignment as in the prior art after the X-ray tube 300 has been mounted at the predetermined position.

Further, since the bracket 400 is formed using FR4, the base portion 310 of the X-ray tube 300 which becomes a high voltage portion and the bottom plate 202 of the X-ray tube container 120 whose potential becomes the ground potential are can effectively be kept insulated from each other. Particularly, since the X-ray tube 300 is attached to the front end portion of the horizontal arm 406 which extends from an upper end of the vertical arm 404, a creeping distance from the mounted portion of the X-ray tube 300 to the bottom plate 202 becomes long, thus ensuring a satisfactory insulation.

Many widely different embodiments of the invention may be constructed without departing from the spirit and the scope of the present invention. It should be understood that the present invention is not limited to the specific embodiments described in the specification, except as defined in the appended claims.

What is claimed is:

1. An X-ray generating apparatus comprising:

an X-ray tube having a base portion, said base portion having a single screw hole and a plurality of pin holes, said screw hole and said pin holes being formed perpendicularly to an end face of said base portion;

a bracket formed by an integral structure of an epoxy laminated glass cloth sheet, said bracket having an abutment face against which the end face of the base portion of said X-ray tube comes into abutment, a screw through hole formed correspondingly to said screw hole and perpendicularly to said abutment face, said screw through hole permitting a screw for threaded engagement with said screw hole to pass therethrough, a plurality of pin through holes formed correspondingly to said plural pin holes and perpendicularly to said abutment face, said pin through holes having the same diameter as the diameter of the corresponding pin holes and permitting pins for insertion into said pin holes to pass therethrough, and a base portion formed in a position spaced in an extending direction of said abutment face from the position where said screw through hole is formed;

a screw which is brought into threaded engagement into the screw hole formed in the base portion of said X-ray tube through said screw through hole from the side opposite to said abutment face in said bracket;

a plurality of pins which are inserted respectively into the plural pin holes formed in the base portion of said X-ray tube through said plural pin through holes from the side opposite to said abutment face in said bracket;

a substrate to which the base portion of said bracket is mounted.

2. An X-ray generating apparatus according to claim 1, wherein the base portion of said bracket has an abutment face for abutment against said substrate, an extending direction of said abutment face being perpendicular to the extending direction of the abutment face against which the end face of the base portion of said X-ray tube comes into abutment.

3. An X-ray generating apparatus according to claim 1, wherein said bracket is bent at substantially right angles at the portion thereof located between the abutment face against which the end face of the base portion of said X-ray tube comes into abutment and the base portion of the bracket.

4. An X-ray generating apparatus according to claim 1, wherein said plural pin holes include two pin holes formed in a pair on mutually opposite sides with respect to said screw hole.

5. An X-ray generating apparatus according to claim 1, wherein said two pin holes formed in a pair are positioned symmetrically with respect to said screw hole.

6. An X-ray generating apparatus according to claim 1, wherein said plural pin holes are positioned at equal intervals on a circumference centered at said screw hole.

7. An X-ray generating apparatus according to claim 1, wherein the number of said plural pin holes is four.

8. An X-ray generating apparatus according to claim 1, wherein the end face of the base portion of said X-ray tube is perpendicular to the axis of the X-ray tube.

* * * * *